US010448790B2

(12) United States Patent
Xie

(10) Patent No.: US 10,448,790 B2
(45) Date of Patent: Oct. 22, 2019

(54) TOILET SEAT CUSHION WITH ADJUSTABLE INSTALLATION LENGTH

(71) Applicant: Fangkui Xie, Yunnan (CN)

(72) Inventor: Fangkui Xie, Yunnan (CN)

(73) Assignee: Finehope (Xiamen) New Material Technology Co., Ltd. (CN)

( * ) Notice: Subject to any disclaimer, the term of this patent is extended or adjusted under 35 U.S.C. 154(b) by 0 days.

(21) Appl. No.: 15/522,090

(22) PCT Filed: Jun. 12, 2015

(86) PCT No.: PCT/CN2015/081363
§ 371 (c)(1),
(2) Date: Apr. 26, 2017

(87) PCT Pub. No.: WO2016/090879
PCT Pub. Date: Jun. 16, 2016

(65) Prior Publication Data

US 2017/0319022 A1 Nov. 9, 2017

(30) Foreign Application Priority Data

Dec. 11, 2014 (CN) ..... 2014 1 0752350

(51) Int. Cl.
*A47K 13/26* (2006.01)
*A47K 13/28* (2006.01)
(Continued)

(52) U.S. Cl.
CPC ..... *A47K 13/26* (2013.01); *A47K 13/12* (2013.01); *A47K 13/28* (2013.01); *A47K 13/242* (2013.01)

(58) Field of Classification Search
CPC ..... A47K 13/12; A47K 13/26; A47K 13/28
(Continued)

(56) References Cited

U.S. PATENT DOCUMENTS

2010/0306909 A1* 12/2010 Chen ..... A47K 13/26 4/236

FOREIGN PATENT DOCUMENTS

| | | | |
|---|---|---|---|
| CN | 201044735 | Y | 4/2008 |
| JP | 2002017616 | A | 1/2002 |
| JP | 2004329489 | A | 11/2004 |

OTHER PUBLICATIONS

Household Tips Guide dated Jul. 10, 2007 and printed Sep. 12, 2018.*

* cited by examiner

*Primary Examiner* — Christine J Skubinna

(57) ABSTRACT

A toilet seat cushion with an adjustable installation length comprises a toilet seat cushion body and an installation length adjustment structure; the installation length adjustment structure is disposed at the rear end of the toilet seat cushion body; the installation length adjustment structure comprises a connecting member and a fixing member; the connecting member is movably connected to the rear end of the toilet seat cushion body; the fixing member comprises two side plates and a positioning plate; the two side plates perpendicularly extend forwards from two ends of the positioning plate respectively; each side plate is provided with an installation hole used for installing the toilet seat cushion body; the positioning plate is detachably positioned onto the connecting member; in this way, the center of each installation hole has a first position and a second position, and the center of each installation hole switches between the first position and the second position with the cooperation of the positioning plate and the connecting member; by means of the structure, the installation length of the toilet seat cushion is adjustable, and accordingly, the toilet seat cushion can match toilet bases with different specifications, thereby improving the applicability of the toilet seat cushion.

5 Claims, 4 Drawing Sheets

(51) Int. Cl.
*A47K 13/12* (2006.01)
*A47K 13/24* (2006.01)

(58) Field of Classification Search
USPC ..... 4/236, 240
See application file for complete search history.

TOILET SEAT CUSHION WITH ADJUSTABLE INSTALLATION LENGTH

TECHNICAL FIELD OF THE INVENTION

The present invention relates to the technical field of toilet seat cushions, and more particularly, to a toilet seat cushion with an adjustable installation length.

BACKGROUND OF THE INVENTION

With the development of living standard, seat toilets are widely used to replace the traditional sanitation fixtures installed in household bathrooms and public lavatories, which are universally welcomed due to the special functions.

In the prior art, a seat toilet is usually composed of a toilet lid, a toilet seat cushion and a base. The toilet seat cushion, which is disposed between the toilet lid and the base, comprises an arc-shaped seat cushion. Two symmetric connecting edges are respectively disposed at the left end and the right end of the tail portion of the arc-shaped seat cushion, through which the arc-shaped seat cushion is hinged to the toilet base. However, such a traditional design requires the installation length of the toilet seat cushion (namely, the perpendicular distance between the center of the installation hole of the toilet seat cushion and the front end of the toilet seat cushion) to be matched with that of the toilet base (namely, the perpendicular distance between the center of the installation hole of the base and the front end of the base). Otherwise, the seat toilet cannot be properly installed, leading to a very limited choice for the consumers in selecting the toilet seat cushions. Presently, the toilet seat cushions sold on the market usually have an installation length of 16.5 inches or 18.5 inches. Even if some of the products can be adjusted through the interaction between the bolts and the installation holes, they can merely be slightly adjusted to compensate the error produced between the two installation lengths. Namely, these products also require the above two installation lengths to be approximately matched. Consequently, the inconvenience caused by the two installation lengths cannot be thoroughly solved through the above way, but resulting in an unprecise and difficult adjustment.

Given this, the inventor of the present invention has devised a toilet seat cushion with an adjustable length, aiming to solve the shortcomings in the prior art.

SUMMARY OF THE INVENTION

The purpose of the present invention is to solve the shortcomings in the prior art, and provide a toilet seat cushion with an adjustable length, through which the length of the toilet seat cushion can be conveniently adjusted, thereby enabling the toilet seat cushion to adapt to various toilet bases.

To achieve the above purpose, the present invention adopts the following technical solution:

A toilet seat cushion with an adjustable installation length comprises a toilet seat cushion body and an installation length adjustment structure. The installation length adjustment structure is disposed at the rear end of the toilet seat cushion body. The installation length adjustment structure comprises a connecting member and a fixing member. The connecting member is movably connected to the rear end of the toilet seat cushion body. The fixing member comprises two side plates and a positioning plate. The two side plates perpendicularly extend forwards from two ends of the positioning plate respectively. Each side plate is provided with an installation hole used for installing the toilet seat cushion body. The positioning plate is detachably positioned onto the connecting member. In this way, the center of each installation hole has a first position and a second position, and the center of each installation hole switches between the first position and the second position with the cooperation of the positioning plate and the connecting member.

The toilet seat cushion further comprises a connecting base, which is disposed at the rear end of the toilet seat cushion body. The connecting member is hinged within the connecting base.

The connecting base and the toilet seat cushion body are molded in one body.

The front end and the rear end of the connecting member respectively form a first abutting surface and a second abutting surface. The rear end of the toilet seat cushion body forms a first abutting portion used for being abutted against the first abutting surface, and the upper end of the connecting base forms a second abutting portion used for being abutted against the second abutting surface. The left end and the right end of the connecting member are symmetrically provided with limiting openings, through which the positioning plate can be limited within the connecting member.

The two side plates and the positioning plate are molded in one body.

The positioning plate is provided with a first inserting plate, and a first inserting slot is disposed on the first inserting plate. The connecting member is provided with a second inserting plate, and a second inserting slot is disposed on the second inserting plate. The positioning plate is inserted into the connecting member through the interaction between the first inserting slot and the second inserting slot, thereby allowing the positioning plate to be detachably positioned onto the connecting member.

Alternatively, the toilet seat cushion can further comprise a bolt. The positioning plate is provided with a first fixing plate, and a through-hole is disposed on the first fixing plate. The connecting member is provided with a second fixing plate, and a screw hole is disposed on the second fixing plate to correspond to the through-hole. The bolt is inserted through the through-hole of the first fixing plate, and is subsequently connected within the screw hole of the second fixing plate, thereby realizing the locating of the positioning plate and the connecting member.

Compared with the prior art, the present invention has the following advantages:

First, the present invention achieves an adjustable length of the toilet seat cushion, making the toilet seat cushion to be conveniently adjusted without being limited by the toilet base. The toilet seat cushion of the present invention can adapt to toilet bases having different installation lengths, avoiding the difficulty of installing the toilet due to the unmatched installation lengths. Thus, the limitation of selecting the toilet seat cushions can be eliminated, the application range of the toilet seat cushion can be enlarged, and the applicability of the toilet seat cushion can be improved.

Second, the present invention has a simple structure, which can be conveniently used. When need to adjust the installation length of the toilet seat cushion, the positioning plate can be removed from the connecting member. After adjusting the location of the center of the installation hole, the positioning plate can be re-assembled to the connecting member. This process is labor-saving, cost-saving, quick and convenient.

Third, through the interaction between the connecting member and the fixing member, the precision of adjusting the center of the installation hole can be ensured. Thus, the installation length of the toilet seat cushion can respectively reach 16.5 inches and 18.5 inches, enabling the toilet seat cushion to be precisely used.

BRIEF DESCRIPTION OF THE DRAWINGS

To clearly expound the present invention or technical solution, the drawings and embodiments are hereinafter combined to illustrate the present invention. Obviously, the drawings are merely some embodiments of the present invention and those skilled in the art can associate themselves with other drawings without paying creative labor.

MARKING INSTRUCTIONS OF THE DRAWINGS

Toilet Seat Cushion Body 1, Installation Length Adjustment Structure 2, Connecting Member 21, The First Abutting Surface 211 The Second Abutting Surface 212, Fixing Member 22, Side Plate 221, Positioning Plate 222, Installation Hole 223, Limiting Opening 224, Connecting Base 3.

DETAILED DESCRIPTION OF THE INVENTION

Drawings and detailed embodiments are combined hereinafter to elaborate the technical principles of the present invention.

Figure 1:
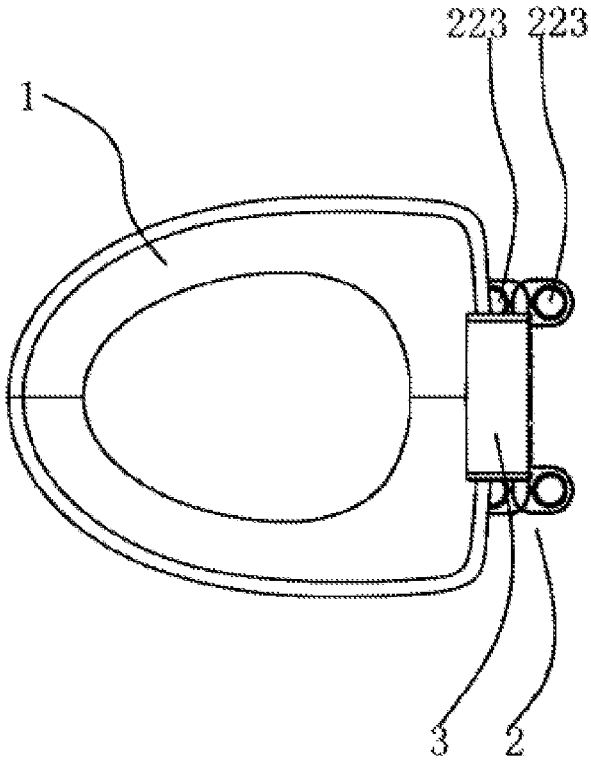
FIG. 1 is a top view of the present invention.
Figure 2:
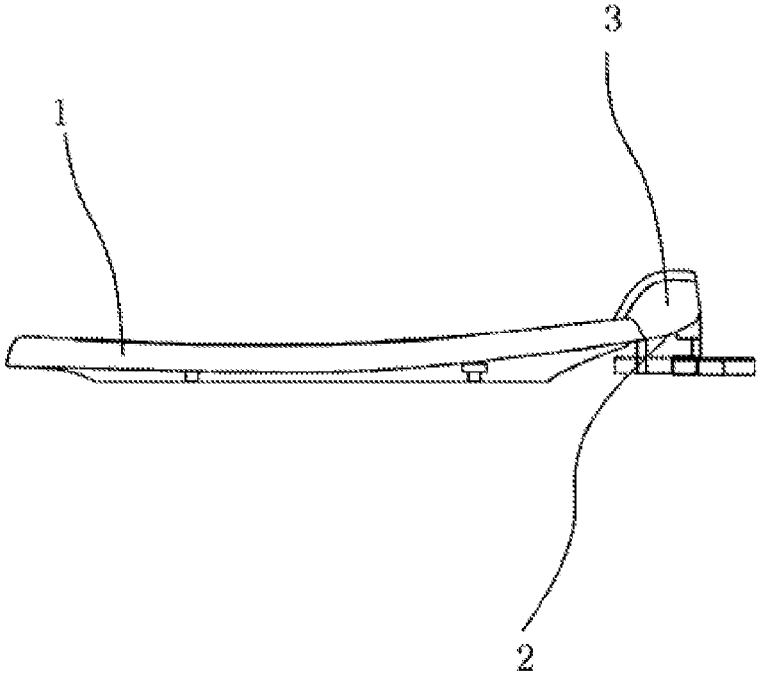
FIG. 2 is a side view of the present invention.
Figure 3:
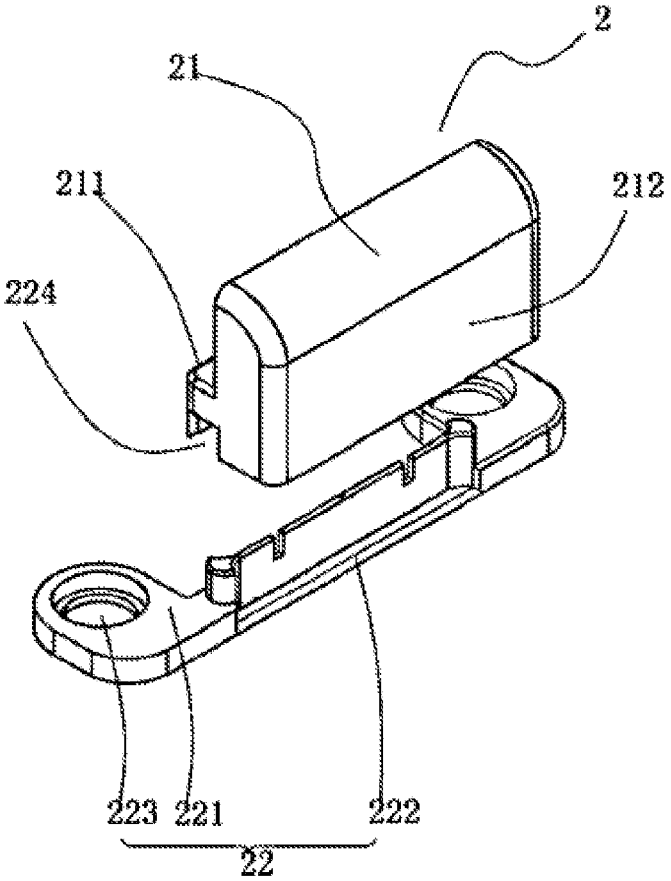
FIG. 3 is a structure diagram of the connecting member and the fixing member of the present invention.
Figure 4:
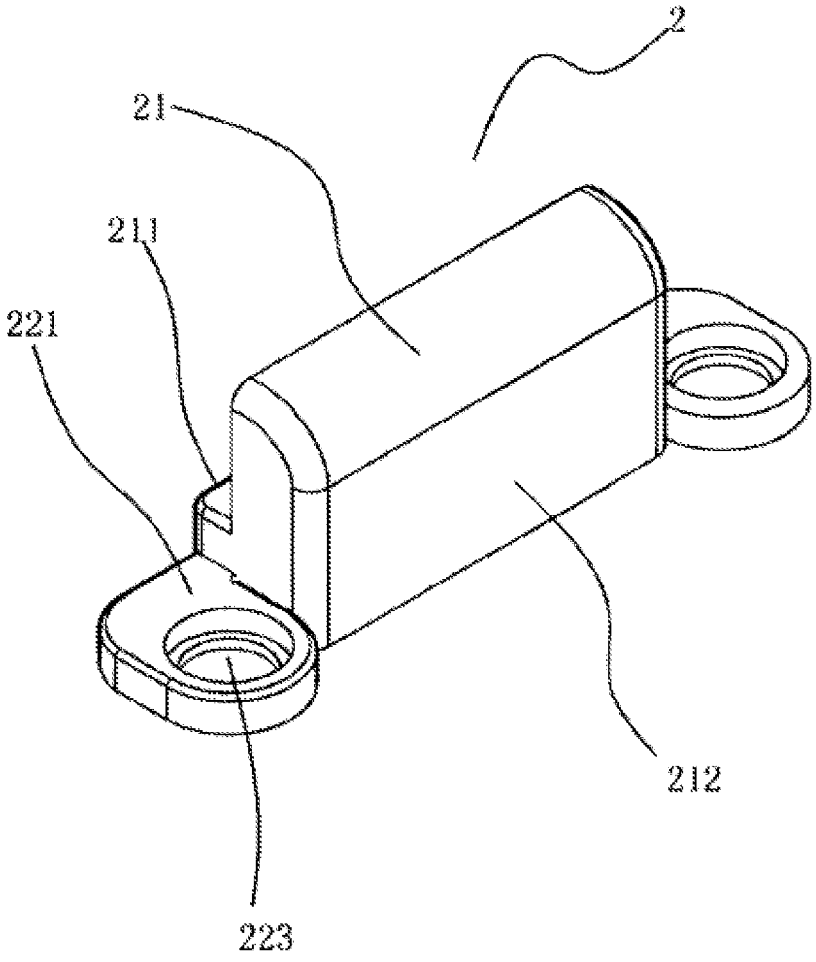
FIG. 4 is a structure diagram showing the assembled connecting member and fixing member of the present invention.

As shown in FIGS. 1-4, the toilet seat cushion with an adjustable installation length of the present invention comprises a toilet seat cushion body 1 and an installation length adjustment structure 2. The installation length adjustment structure 2 is disposed at the rear end of the toilet seat cushion body 1. The installation length adjustment structure 2 comprises a connecting member 21 and a fixing member 22. The connecting member 21 is movably connected to the rear end of the toilet seat cushion body 1. The fixing member 22 comprises two side plates 221 and a positioning plate 222. The two side plates 221 perpendicularly extend forwards from two ends of the positioning plate 222 respectively. Each side plate 221 is provided with an installation hole 223 used for installing the toilet seat cushion body 1. The positioning plate 222 is detachably positioned onto the connecting member 21. In this way, the center of each installation hole 223 has a first position and a second position, and the center of each installation hole 223 switches between the first position and the second position with the cooperation of the positioning plate 222 and the connecting member 21. When the center of the installation hole 223 is located at the first position, the installation length of the toilet seat cushion is 16.5 inches; when the center of the installation hole 223 is located at the second position, the installation length of the toilet seat cushion is 18.5 inches. Thus, the adjustable length of the toilet seat cushion can be achieved.

The connecting member 21 and the toilet seat cushion body 1 can be movably connected through various ways. The toilet seat cushion of this embodiment further comprises a connecting base 3, which is disposed at the rear end of the toilet seat cushion body 1. The connecting member 21 is hinged within the connecting base 3. This arrangement can realize the connection between the connecting member 21 and the toilet seat cushion body 1, and the connecting member 21 can be protected by the connecting base 3 in a certain degree.

In order to firmly install the connecting base 3 onto the toilet seat cushion body 1, the connecting base 3 and the toilet seat cushion body 1 are molded in one body via injection molding method, ensuring a stable structure and a convenient processing.

To ensure the safety during the rotation of the toilet seat cushion body 1, the front end and the rear end of the connecting member 21 respectively form a first abutting surface 211 and a second abutting surface 212. The rear end of the toilet seat cushion body 1 forms a first abutting portion used for being abutted against the first abutting surface 211, and the upper end of the connecting base 3 forms a second abutting portion used for being abutted against the second abutting surface 212. Thus, the rotating angle of the connecting member 21 can be limited.

In this embodiment, the left end and the right end of the connecting member 21 are symmetrically provided with limiting openings 224, through which the positioning plate 222 can be limited within the connecting member 21. Such a configuration effectively limits the movement of the positioning plate 222 in a horizontal direction, enabling the positioning plate 222 to be better positioned onto the connecting member 21. Consequently, the toilet seat cushion body 1 can be prevented from shaking during use, achieving a more stable and reliable usage.

To strengthen the connection between the two side plates 221 and the positioning plate 222, the two side plates 221 and the positioning plate 222 are molded in one body, which can greatly prolong the functional life of the fixing member 22.

The positioning plate 222 can be detachably positioned onto the connecting member 21. The detachable installation can be achieved through various ways. Specifically, the positioning plate 222 is provided with a first inserting plate, and a first inserting slot is disposed on the first inserting plate. The connecting member 21 is provided with a second inserting plate, and a second inserting slot is disposed on the second inserting plate. The positioning plate 222 is inserted into the connecting member 21 through the interaction between the first inserting slot and the second inserting slot. The whole disassembling process can be completed without assistance of any auxiliary tool, which is convenient and space-saving.

Alternatively, the toilet seat cushion can further comprise a bolt. The positioning plate 222 is provided with a first fixing plate. A through-hole is disposed on the first fixing plate. The connecting member 21 is provided with a second fixing plate, and a screw hole is disposed on the second fixing plate to correspond to the through-hole. The bolt is inserted through the through-hole of the first fixing plate, and is subsequently connected within the screw hole of the second fixing plate, thereby realizing the locating of the positioning plate 222 and the connecting member 21. According to this arrangement, the structure can be optimized, and the locating of the positioning plate 222 and the connecting member 21 can be reinforced.

During use of the present invention, the fixing member 22 can adjust the position of the center of the installation hole 223 through the interaction between the fixing member 22 and the positioning plate 222. When the direction of the installation hole 223 faces the front end of the toilet seat cushion body 1 (namely, the center of the installation hole 223 is located at the first position), the installation length of the toilet seat cushion body 1 is 16.5 inches; when the direction of the installation hole 223 faces the rear end of the toilet seat cushion body 1 (namely, the center of the installation hole 223 is located at the second position), the installation length of the toilet seat cushion body 1 is 18.5 inches.

Compared with the prior art, the present invention has the following advantages:

First, the present invention achieves an adjustable length of the toilet seat cushion, making the toilet seat cushion to be conveniently adjusted without being limited by the toilet base. The toilet seat cushion of the present invention can adapt to toilet bases having different installation lengths, avoiding the difficulty of installing the toilet due to the unmatched installation lengths. Thus, the limitation of selecting the toilet seat cushions can be eliminated, the application range of the toilet seat cushion can be enlarged, and the applicability of the toilet seat cushion can be improved.

Second, the present invention has a simple structure, which can be conveniently used. When need to adjust the installation length of the toilet seat cushion, the positioning plate 222 can be removed from the connecting member 21. After adjusting the location of the center of the installation hole 223, the positioning plate 222 can be re-assembled to the connecting member 21. This process is labor-saving, cost-saving, quick and convenient.

Third, through the interaction between the connecting member 21 and the fixing member 22, the center of the installation hole 223 can be precisely adjusted. Thus, the installation length of the toilet seat cushion can respectively reach 16.5 inches and 18.5 inches, enabling the toilet seat cushion to be precisely used.

The description of above embodiments allows those skilled in the art to realize or use the present invention. Without departing from the spirit and essence of the present invention, those skilled in the art can combine, change or modify correspondingly according to the present invention. Therefore, the protective range of the present invention should not be limited to the embodiments above but conform to the widest protective range which is consistent with the principles and innovative characteristics of the present invention. Although some special terms are used in the description of the present invention, the scope of the invention should not necessarily be limited by this description. The scope of the present invention is defined by the claims.

The invention claimed is:

1. A toilet seat cushion with an adjustable installation length, comprising:

a toilet seat cushion body having a front end and rear end, and an installation length adjustment structure, wherein the installation length adjustment structure is disposed at the rear end of the toilet seat cushion body, wherein the installation length adjustment structure comprises:

a connecting member having a front end, a rear end, a left end, and a right end, and a fixing member, wherein the connecting member further comprising a limiting opening, wherein the fixing member comprises two side plates and a positioning plate, wherein the two side plates perpendicularly extend forwards from two ends of the positioning plate respectively, wherein each side plate is provided with an installation hole used for installing the toilet seat cushion body, wherein the positioning plate is detachably positioned onto the connecting member, wherein centers the installation holes are aligned with each other but not aligned with the center the positioning plate, wherein the fixing member can be connected to the connecting member through the limiting opening to establish a first position and a second position, wherein the first position is established when the center of each installation hole is placed on a side of the position plate closer to the front end of the connecting member, wherein the second position is established when the center of each installation hole is placed on a side of the position plate closer to the rear end of the connecting member, wherein when the first position is established, the installation length of the toilet seat cushion is 16.5 inches, and wherein when the second position is established, the installation length of the toilet seat cushion is 18.5 inches.

2. The toilet seat cushion with an adjustable installation length of claim 1, wherein the connecting base and the toilet seat cushion body is a single piece.

3. The toilet seat cushion with an adjustable installation length of claim 1, wherein the front end and the rear end of the connecting member respectively form a first abutting surface and a second abutting surface, and wherein the rear end of the toilet seat cushion body forms a first abutting portion used for being abutted against the first abutting surface, and the upper end of the connecting base forms a second abutting portion used for being abutted against the second abutting surface.

4. The toilet seat cushion with an adjustable installation length of claim 1, wherein the left end and the right end of the connecting member are symmetrically provided with limiting openings, through which the positioning plate can be limited within the connecting member.

5. The toilet seat cushion with an adjustable installation length of claim 1, wherein the two side plates and the positioning plate are molded in one body.

* * * * *